US009129556B2

(12) United States Patent
Park

(10) Patent No.: US 9,129,556 B2
(45) Date of Patent: Sep. 8, 2015

(54) DISPLAY DEVICE

(71) Applicant: Kyong-Tae Park, Yongin (KR)

(72) Inventor: Kyong-Tae Park, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 110 days.

(21) Appl. No.: 13/946,256

(22) Filed: Jul. 19, 2013

(65) Prior Publication Data

US 2014/0292821 A1 Oct. 2, 2014

(30) Foreign Application Priority Data

Apr. 2, 2013 (KR) ..... 10-2013-0035921

(51) Int. Cl.
*G09G 3/32* (2006.01)

(52) U.S. Cl.
CPC ..... *G09G 3/3208* (2013.01); *G09G 3/3233* (2013.01); *G09G 2320/0626* (2013.01); *G09G 2360/16* (2013.01)

(58) Field of Classification Search
CPC ..... G09G 2320/0276; G09G 2360/16; G09G 2320/0626; G09G 3/3208
USPC ..... 345/76–100, 204, 214, 690
See application file for complete search history.

(56) References Cited

U.S. PATENT DOCUMENTS

| | | | | |
|---|---|---|---|---|
| 2002/0011796 | A1* | 1/2002 | Koyama | 315/169.1 |
| 2003/0214469 | A1* | 11/2003 | Kageyama et al. | 345/82 |
| 2005/0057191 | A1* | 3/2005 | Jo et al. | 315/291 |
| 2008/0074361 | A1 | 3/2008 | Lee et al. | |
| 2008/0122758 | A1 | 5/2008 | Kim et al. | |
| 2009/0040207 | A1 | 2/2009 | Park et al. | |
| 2010/0149162 | A1 | 6/2010 | Park et al. | |
| 2010/0238149 | A1* | 9/2010 | Kishi et al. | 345/206 |

FOREIGN PATENT DOCUMENTS

| | | | |
|---|---|---|---|
| KR | 10-2008-0028222 | A | 3/2008 |
| KR | 10-2008-0048876 | A | 6/2008 |
| KR | 10-2009-0014561 | A | 2/2009 |
| KR | 10-2010-0068075 | A | 6/2010 |

* cited by examiner

*Primary Examiner* — Robin Mishler
*Assistant Examiner* — Mansour M Said
(74) *Attorney, Agent, or Firm* — Lee & Morse, P.C.

(57) ABSTRACT

A display device includes a scan driver, a data driver, a power supply unit configured to supply power through a plurality of power supply inlet portions, a pixel unit including a plurality of pixels that receives scan signals, emission control signals, data signals and the power so as to display an image, the pixel unit being partitioned into a plurality of partition areas to correspond to the respective power supply inlet portions, and a current limit circuit configured to calculate values of current for each of the partition areas based on gray scale data of an image signal, and configured to correct the gray scale data so as to limit luminance of the pixel unit when at least one of the values of current for each partition area is a reference value or more.

9 Claims, 4 Drawing Sheets

DISPLAY DEVICE

CROSS-REFERENCE TO RELATED APPLICATION

This application claims priority to and the benefit of Korean Patent Application No. 10-2013-0035921, filed on Apr. 2, 2013, in the Korean Intellectual Property Office, the entire contents of which are incorporated herein by reference in there entirety.

BACKGROUND

1. Field

Embodiments relate to an organic light emitting display device.

2. Description of the Related Art

Recently, there have been developed various types of displays capable of reducing the disadvantageous weight and volume of cathode ray tubes. The displays include a liquid crystal display, a field emission display, a plasma display panel, an organic light emitting display, and the like.

Among these displays, the organic light emitting display displays images using organic light emitting diodes (OLEDs) that emit light through recombination of electrons and holes. The organic light emitting display has a fast response speed and is driven with low power consumption.

SUMMARY

Embodiments are directed to a display device, including a scan driver configured to apply scan signals and emission control signals through a plurality of scan lines and a plurality of emission control lines, a data driver configured to apply data signals through a plurality of data lines, a power supply unit configured to supply power through a plurality of power supply inlet portions, a pixel unit including a plurality of pixels that receives the scan signals, the emission control signals, the data signals and the power so as to display an image, the pixel unit being partitioned into a plurality of partition areas to correspond to the respective power supply inlet portions, and a current limit circuit configured to calculate values of current for each of the partition areas based on gray scale data of an image signal, and configured to correct the gray scale data so as to limit luminance of the pixel unit when at least one of the values of current for each partition area is a reference value or more.

The current limit circuit may include a conversion unit configured to convert the gray scale data into a data current value, a calculation unit configured to calculate current values for each partition area by dividing the data current value, based on a predetermined current distribution rate for each partition area, and to accumulate data current values for one frame, and a comparison unit configured to decide whether the current values for each partition area are within a reference range.

The current limit circuit may further include a correction unit configured to correct the gray scale data, based on a correction coefficient, and a correction coefficient regulation unit configured to regulate the size of the correction coefficient according to the decision of the comparison unit.

The correction coefficient regulation unit may decrease the correction coefficient when the maximum value among the current values for each partition area is no less than an upper limit of the reference range, and increase when the maximum value among the current values for each partition area is no greater than a lower limit of the reference range.

The correction coefficient may be a value between 0 and 1.

The current limit circuit may output a control signal for limiting the luminance of the pixel unit.

The control signal may include a data control signal output to the data driver or a scan control signal output to the scan driver.

The data driver may output, as a data signal, a gray scale voltage selected according to the data control signal.

The scan driver may control a pulse width of the emission control signals according to the scan control signal.

The power supply inlet portions may be arranged at a top and bottom of an outside of the pixel unit, or at the left and right of the outside of the pixel unit, or at the top, bottom, left and right of the outside of the pixel unit.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it may be the only element between the two elements, or one or more intervening elements may also be present. Like reference numerals refer to like elements throughout.

DETAILED DESCRIPTION

Figure 1:
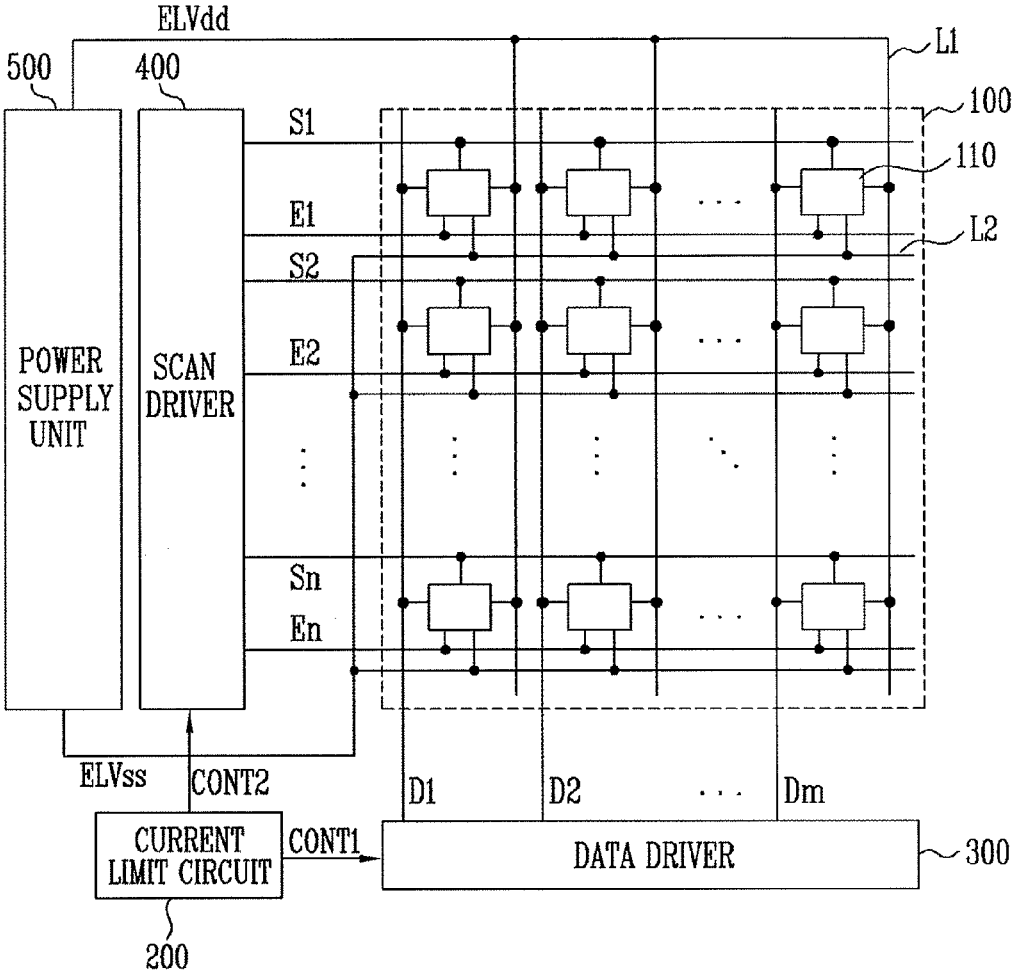
FIG. 1 is a schematic block diagram illustrating an organic light emitting display according to an example embodiment.

Hereinafter, certain example embodiments will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a schematic block diagram illustrating an organic light emitting display according to an example embodiment.

Referring to FIG. 1, the organic light emitting display according to this example embodiment includes a pixel unit 100, a current limit circuit 200, a data driver 300, a scan driver 400 and a power supply unit 500.

In this example embodiment, the pixel unit 100 includes a plurality of pixels 110, and n scan lines S1 to Sn, n emission control lines E1 to En and in data lines D1 to Dm are formed in the pixel unit 100. Here, the plurality of pixels 110 are formed at intersection portions of the scan lines S1 to Sn, the emission control lines E1 to En and the data lines D1 to Dm, and each include an organic light emitting diode and at least two transistors. The scan lines S1 to Sn are formed in a first direction to provide a scan signal to the pixels therethrough. The emission control lines E1 to En provide an emission control signal to the pixels therethrough. The data lines D1 to Dm are formed in a second direction intersecting the first direction to provide a data signal to the pixels therethrough.

First power lines L1 for providing a first power source ELVdd to each pixel 110 and second power lines L2 for providing a second power source ELVss to each pixel 110 are arranged in the pixel unit 100. The first and second power sources ELVdd and ELVss are electrically coupled to anode and cathode electrodes of the organic light emitting diode provided in each pixel 110.

The first and second power sources ELVdd and ELVss are supplied from the power supply unit 500. The first power source ELVdd has a voltage higher than that of the second power source ELVss.

Thus, in the organic light emitting display, a driving transistor included in each pixel supplies, to the organic light emitting diode, data current with an amplitude corresponding to that of a data signal from a data line coupled to the driving transistor, and accordingly, light is generated from the organic light emitting diode, thereby displaying a predetermined image.

In this case, the data current flows through a current path formed by a difference in voltage between the first and second power sources, respectively provided to anode and cathode electrodes of the organic light emitting diode.

Although not shown in FIG. 1, the first power source ELVdd supplied from the power supply unit 500 is provided to each pixel 110 of the pixel unit 100 through a plurality of power supply inlet portions (not shown) formed in an outer area of the pixel unit 100.

Thus, the first power lines L1 may be provided to the pixel unit 100 by forming a predetermined group for each power supply inlet portion. Accordingly, the pixel unit 100 may be partitioned into a plurality of partition areas to correspond to the respective power supply inlet portions.

In this case, the power supply inlet portions may be arranged at the top and bottom of the outside of the pixel unit 100 or at the top, bottom, left and right of the outside of the pixel unit 100. An example embodiment of the arrangement of the power supply inlet portions will be shown in FIG. 3.

The second power lines L2 having the second power source ELVss provided therethrough are equivalently shown in FIG. 1. However, the second power lines L2 may be integrally formed in the entire area of the pixel unit 100 so as to be electrically coupled to each pixel 110.

The current limit circuit 200 controls the data driver 300 or the scan driver 400 and performs a function of limiting the luminance of the pixel unit 100 not to exceed a certain level.

When the area in which a high-luminance (or high-gray-scale) image is displayed in the pixel unit 100 is large, i.e., when a large number of pixels in which a large data current is applied to the organic light emitting diodes exist in the pixel unit 100, the luminance of the pixel unit 100 is expressed higher than that when the area in which the high-luminance (or high-gray-scale) image is displayed in the pixel unit 100 is small.

For example, when the pixel unit 100 emits full-white light, the luminance of the pixel unit 100 is expressed higher than that when the pixel unit 100 emits no full-white light. In this case, a large amount of current flows in the pixel unit 100, and therefore, a large load is applied to the power supply unit providing the first and second power sources. Accordingly, power consumption is increased, and degradation occurs due to heat generation, thereby lowering display quality.

In order to solve such a problem, when the area in which the high-luminance (or high-gray-scale) image is displayed in the pixel unit 100 is large, the current limit circuit 200 outputs control signals CONT1 and CONT2 to the respective data and scan drivers 300 and 400. Thus, the current limit circuit 200 limits data current accumulated in the entire pixel unit 100 so that the luminance of the pixel unit 100 does not exceed a certain level. Accordingly, the brightness of an image displayed in the pixel unit 100 may be entirely decreased.

Although it has been illustrated in FIG. 1 that both the control signals are applied to the respective data and scan drivers 300 and 400, this is provided for convenience of illustration. Thus, the control signal may be applied to only one of the data and scan drivers 300 and 400.

For example, in a case where the data control signal CONT1 is applied to the data driver 300, the data driver 300 outputs, to the pixel unit 100, a gray scale voltage selected according to the data control signal CONT1 as the data signal CONT1.

On the other hand, in a case where the scan control signal CONT2 is applied to the scan driver 400, the scan driver 400 adjusts the pulse width of an emission control signal so as to correspond to the scan control signal CONT2. Thus, when the area in which the high-luminance (or high-gray-scale) image is displayed in the pixel unit 100 is large, the pulse width of the emission control signal, which is shorter than that of the existing emission control signal, is applied by the scan control signal CONT2, so that the amount of data current flowed in the pixel unit 100 is decreased, thereby lowering the entire luminance of the pixel unit 100.

The current limit circuit 200 according to this example embodiment calculates a current value applied to each partition area, based on gray scale data of an image signal, in the pixel unit 100 partitioned into the plurality of partition areas to correspond to the respective power supply inlet portions. In a case where at least one of the current values applied to the respective partition areas is a reference value or more, the current limit circuit 200 limits the data current applied to the entire pixel unit 100, so that the brightness of an image expressed in the pixel unit 100 is entirely decreased.

Thus, the current limit circuit 200 detects the amplitude of current applied to each partition area of the pixel unit 100 partitioned, based on the positions of the power supply inlet portions to which power is supplied, thereby controlling the luminance of an image so that excessive current does not flow.

Accordingly, it is possible to overcome a disadvantage in that when a high-luminance (or high-gray-scale) data is applied to only a specific area of the pixel unit 100, i.e., when a large amount of current is applied to only pixels in the specific area, excessive current flows in the inlet portions of the power supply unit, and therefore, heat generation becomes serious.

The data driver 300 applies a data signal to the pixel unit 100. The data driver 300 receives video data having red, blue and green elements so as to generate a data signal. The data driver 300 is coupled to the data lines D1 to Dm of the pixel unit 100 so as to apply the generated data signal to the pixel unit 100. In this case, as described above, the data driver 300 may provide, to the pixel unit 100, a gray scale voltage selected according to the data control signal CONT1 as the data signal.

The scan driver 400 applies a scan signal and an emission control signal to the pixel unit 100. The scan driver 400 is coupled to the scan lines S1 to Sn and the emission control lines E1 to En so as to provide the scan signal and the emission control signal to a specific row of the pixel unit 100. In this case, as described above, the scan driver 400 may adjust the pulse width of the emission control signal to correspond to the scan control signal CONT2.

The data signal output from the data driver 300 is provided to the pixels 110 to which the scan signal is provided. The pixels 100 having the emission control signal provided thereto emit light according to the emission control signal.

The scan driver 400 may include a scan driving circuit generating scan signals and an emission driving circuit generating emission control signals. The scan driving circuit and the emission driving circuit may be included as one component or may be separated as separate components.

The data signal input from the data driver 300 is applied to a specific row of the pixel unit 100 to which the scan signal is provided, and current corresponding to the data signal is provided to the pixels so that an image is displayed by the emission of the pixels. In this case, all the rows are sequentially selected, thereby completing one frame.

Figure 2:
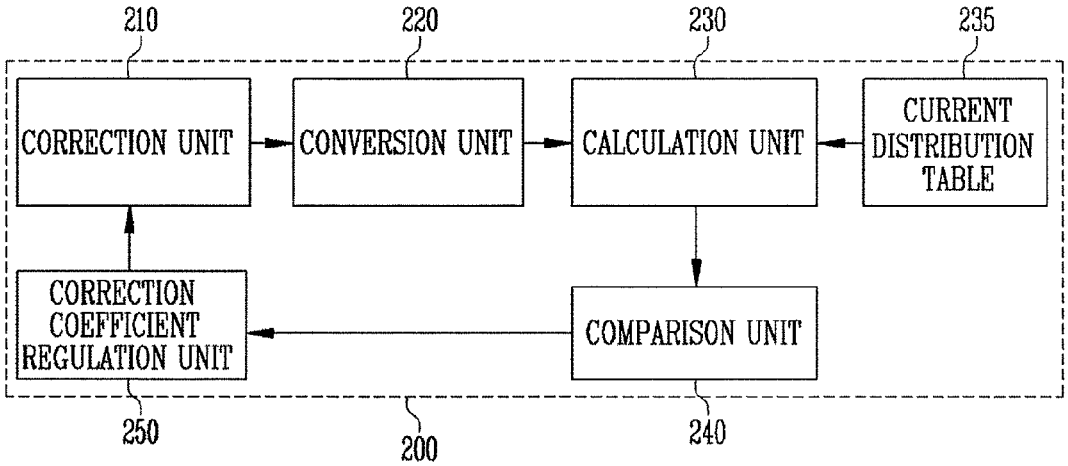
FIG. 2 is a block diagram illustrating the configuration of a current limit circuit shown in FIG. 1.
Figure 3:
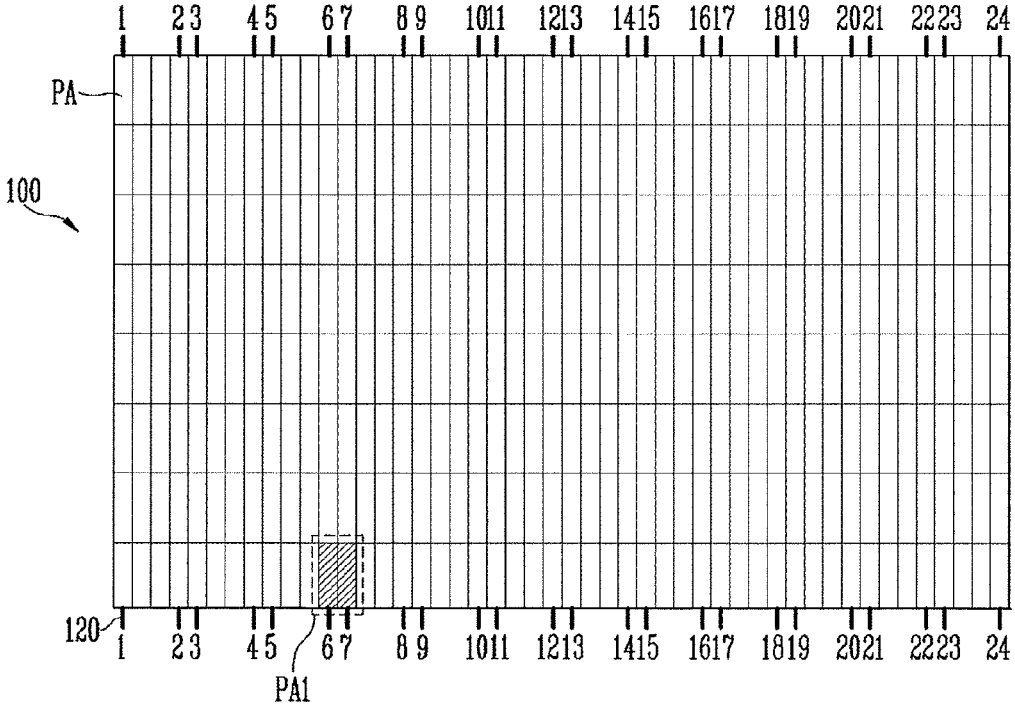
FIG. 3 is a view illustrating partition areas of a pixel unit according to an example embodiment.
Figure 4:
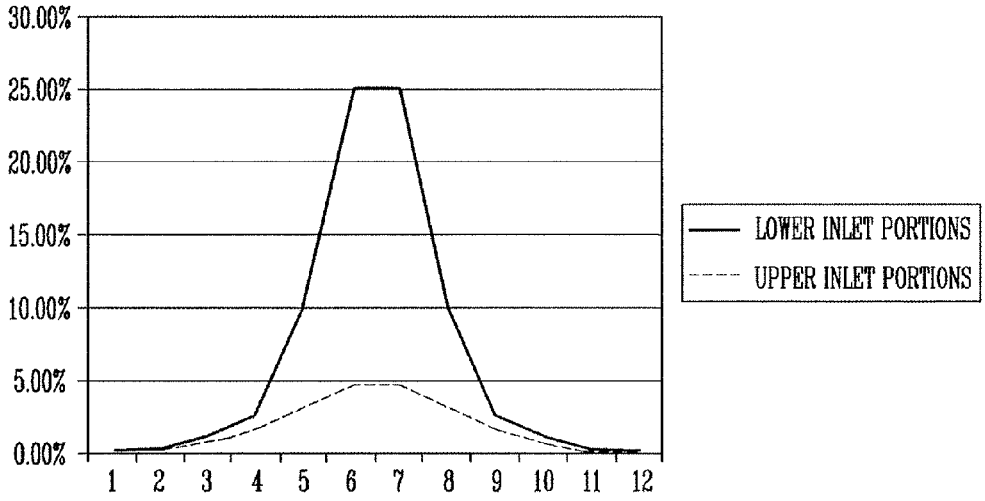
FIG. 4 is a graph illustrating distributions of current applied to the partition areas shown in FIG. 3.

FIG. 2 is a block diagram illustrating the configuration of the current limit circuit shown in FIG. 1. FIG. 3 is a view illustrating partition areas of a pixel unit according to an example embodiment. FIG. 4 is a graph illustrating distributions of current applied to the partition areas shown in FIG. 3.

Referring to FIG. 2, the current limit circuit 200 includes a correction unit 210 correcting gray scale data of an image signal, based on a correction coefficient; a conversion unit 220 converting the corrected gray scale data into a data current value; a calculation unit 230 calculating current values for each area by dividing the data current value, based on a predetermined current distribution rate for each area, and accumulating data current values for one frame; a comparison unit 240 deciding whether the current values for each area are within a reference range; and a correction coefficient regulation unit 250 regulating the size of the correction coefficient according to the decision of the comparison unit 240.

In a case where the maximum value among the current values for each area is no less than an upper limit of the reference range, the correction coefficient regulation unit 250 decreases the correction coefficient. In a case where the maximum value among the current values fore each area is no greater than a lower limit of the reference range, the correction coefficient regulation unit 250 increases the correction coefficient.

The current limit circuit 200 may further include a current distribution table 235 in which the current distribution rate for each area, which is set according to characteristics of a display device.

As described in FIG. 1, the first power source ELVdd supplied from the power supply unit 500 is provided to each pixel 110 of the pixel unit 100 through the plurality of power supply inlet portions formed in the outer area of the pixel unit 100. Thus, the first power source ELVdd is provided to the pixel unit 100 by forming a predetermined group for each power supply inlet portion, and accordingly, the pixel unit 100 may be partitioned into a plurality of partition areas to correspond to the respective power supply inlet portions.

In this case, the power supply inlet portions may be arranged at the top and bottom of the outside of the pixel unit 100, or at the top, bottom, left and right of the outside of the pixel unit 100. An example embodiment of the arrangement of the power supply inlet portions is shown in FIG. 3.

Referring to FIG. 3, the power supply inlet portion 120 illustrates an example embodiment in which the power supply inlet portions are arranged at the top and bottom of the outside of the pixel unit 100. In this case, the pixel unit 100 may be partitioned into a plurality of partition areas PA having the same area and shape.

Here, each partition area PA includes the same number of pixels 110, and each pixel 110 has the same electrical characteristic. Therefore, the pixel unit 100 may be replaced with a mesh-shaped equivalent circuit network having equivalent resistances corresponding to the respective partition areas PA.

Specifically, the current distribution rate for each area is previously set according to electrical characteristics of the pixel unit 100. In this case, as described above, the current distribution rate may be modeled using the equivalent circuit network of the pixel unit 100.

Referring to FIG. 4, the distribution of current applied to the whole partition areas PA may be detected, based on emission of a specific area PA1 shown in FIG. 3 among the partition areas PA.

Specifically, a large amount of current is applied through sixth and seventh lower power supply inlet portions adjacent to the specific area PA1, and the value of the applied current is decreased as it is distant from the specific area PA1 to the left/right and top/bottom.

The current distribution rate of each partition area PA may be estimated through such a model. In a case where a plurality of areas emit light, the distributed current values are accumulated and added, thereby calculating the value of current applied to each area.

Here, data current values may be accumulated and added as an average of data current values of pixels belonging to one partition area PA.

Meanwhile, although it has been illustrated in this example embodiment that the equally partitioned areas PA are arranged in a matrix form, the present embodiment is not limited thereto. Thus, the partition areas PA may be arranged in a lateral or longitudinal stripe form, or may be unequally partitioned.

Figure 5:
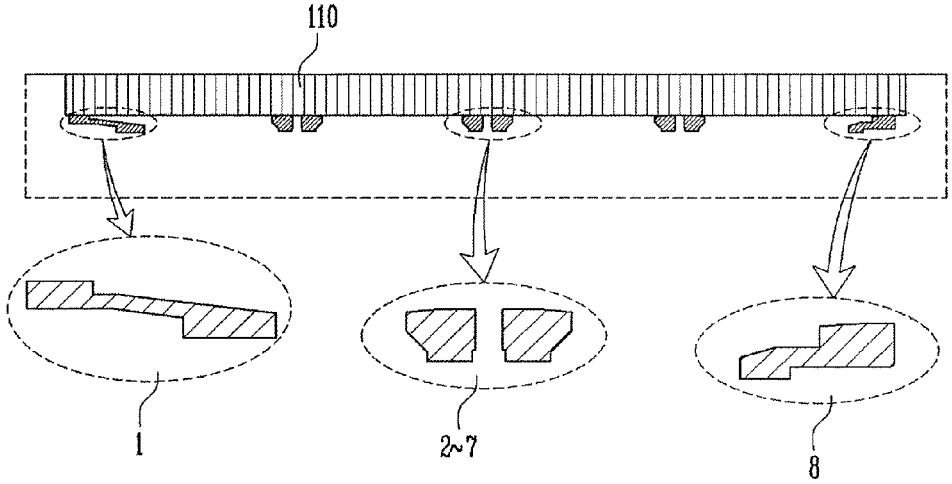
FIG. 5 is a view illustrating widths and shapes of power supply inlet portions according to an example embodiment.

FIG. 5 is a view illustrating widths and shapes of power supply inlet portions according to an example embodiment.

The resistances of the equivalent circuit network in the pixel unit 100 may be different from those of the power supply inlet portions according to their positions. For example, the vertical resistance may be smaller than the horizontal resistance in the pixel unit 100, and the resistance of an inlet portion positioned at the outside among the power supply inlet portions positioned at a side portion of the pixel unit 100 may be greater than that of other inlet portions.

Figure 6:
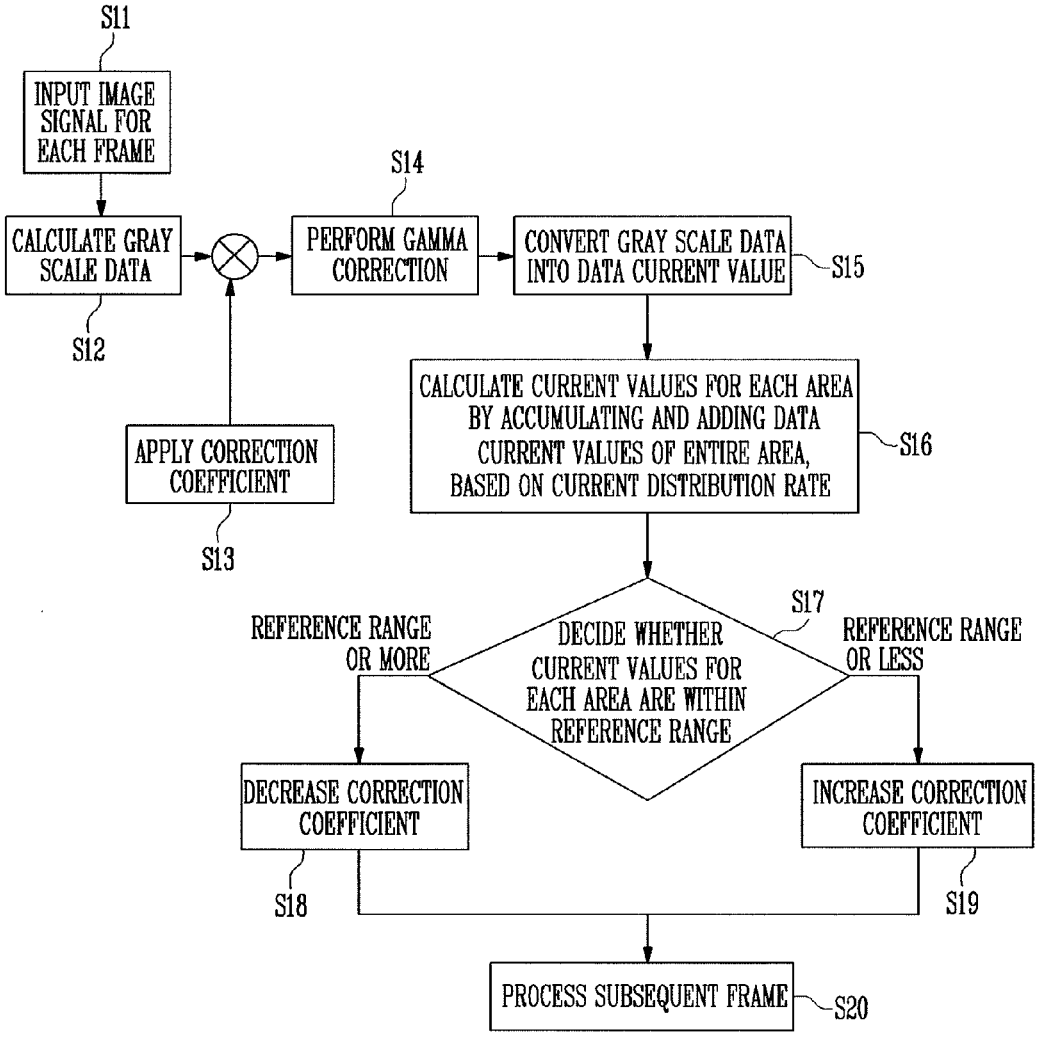
FIG. 6 is a flowchart illustrating an operation of the current limit circuit.

FIG. 6 is a flowchart illustrating an operation of the current limit circuit.

The operation of the current limit circuit 200 will be described with reference to FIG. 6.

First, an image signal for each frame is input to the current limit circuit 200 (S11). The correction unit 210 calculates gray scale data included in the input image signal (S12) and applies a correction coefficient (S13), thereby performing gamma correction for correcting the gray scale data (S14). Accordingly, the gray scale of a corresponding frame is regulated. Here, the correction coefficient is a value between 0 and 1. In a case where excessive current is supplied to a specific area, the value of the correction coefficient is decreased.

The conversion unit 220 converts the corrected gray scale data into a data current value (S15). The calculation unit 230 calculates current values for each area by dividing the converted data current value, based on a predetermined current distribution rate for each area, and accumulating data current values for one frame (S16).

Specifically, the current distribution rate for each area is previously set according to electrical characteristics of the pixel unit 100. In this case, as described above, the current distribution rate may be modeled using the equivalent circuit network of the pixel unit 100.

Referring back to FIGS. 3 and 4, the distribution of current applied to the whole partition areas PA may be detected, based on emission of a specific area PA1 shown in FIG. 3 among the partition areas PA.

Next, the comparison unit 240 decides whether the current values for each area are within a predetermined reference range (S17). The correction coefficient regulation unit 250 regulates the size of the correction coefficient according to the decision result of the comparison unit 240.

Here, the comparison unit 240 may decides by selecting only the maximum value among the current values for each area.

Specifically, in a case where the maximum value among the current values for each area is no less than an upper limit of the reference range as the decision result of the comparison unit 240, the correction coefficient regulation unit 250 decreases the correction coefficient (S18). In a case where the maximum value among the current values for each area is no greater than a lower limit of the reference range as the decision result of the comparison unit 240, the correction coefficient regulation unit 250 increases the correction coefficient (S19).

The regulation of the correction coefficient is performed for each frame. In a case where the current values for each area are within the reference range, the correction coefficient is maintained, and the control signal generated by the current limit circuit 200 does not limit luminance.

The correction process of one frame is completed, a subsequent frame is processed to repeat the procedure described above (S20).

In a case where the current values for each area is out of the reference range, the current limit circuit 200 may output a control signal for limiting luminance according to the decision of the comparison unit 240 while correcting the gray scale data.

Thus, the gray scale voltage of a data signal is controlled by outputting the data control signal CONT1 to the data driver 300, or the pulse width of an emission control signal may be controlled by outputting the scan control signal CONT2 to the scan driver 400.

Accordingly, it may be possible to overcome a disadvantage in that when a high-luminance (or high-gray-scale) data is applied to only a specific area of the pixel unit 100, i.e., when a large amount of current is applied to only pixels in the specific area, excessive current flows in the inlet portions of the power supply unit, and therefore, heat generation becomes serious.

By way of summation and review, an organic light emitting display may include a plurality of data lines, a plurality of scan lines, and a pixel unit including a plurality of pixels formed at intersection portions of the data lines and the scan lines. Each pixel may include an OLED and a driving transistor coupled to the OLED. A first power source and a second power source may be supplied to the pixel unit so as to apply a predetermined voltage to anode and cathode electrodes of the OLED provided in each pixel. In the organic light emitting display, the driving transistor included in each pixel supplies data current corresponding to that of a data signal supplied from the data line coupled to the driving transistor, and accordingly, light is emitted from the OLED, thereby displaying a predetermined image. In this case, the data current flows through a current path formed by a difference between voltages of the first and second power sources, provided to the anode and cathode electrodes of the OLED.

In a case where the organic light emitting display displays a high-luminance (high-gray-scale) image, a large amount of current flows through the organic light emitting diode of each pixel included in the pixel unit. In a case where the organic light emitting display displays a low-luminance (low-gray-scale) image, a small amount of current flows through the organic light emitting diode of each pixel.

However, in a case where the high-luminance (or high-gray-scale) image is displayed, a large amount of current flows in the pixel unit. Accordingly, a large load is applied to the power supply unit providing the first and second power sources, and therefore, power consumption is increased.

In order to solve such a problem, an organic light emitting display may use a method of measuring current flowing in the entire pixel unit and limiting the current when the value of the current is a critical value or more. However, according to such a method, when a high-luminance (or high-gray-scale) data is applied to only a specific area of the pixel unit, the current of the entire pixel unit is the critical value or less, and therefore, the current is not limited. Accordingly, it is difficult to overcome the disadvantage in that when a large amount of current is applied to only pixels in the specific area, excessive current flows in the inlet portions of the power supply unit, and therefore, heat generation becomes serious.

Thus, when data current excessively flows in the pixel unit partitioned into a plurality of areas, the organic light emitting display limits the luminance of the pixel unit by deciding that the data current has excessively flowed in the pixel unit, so that it may be possible to prevent a power supply inlet portion corresponding to the specific area from generating heat.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope as set forth in the following claims.

What is claimed is:

1. A display device, comprising:

a scan driver configured to apply scan signals and emission control signals through a plurality of scan lines and a plurality of emission control lines;

a data driver configured to apply data signals through a plurality of data lines;

a power supply unit configured to supply power through a plurality of power supply inlet portions;

a pixel unit including a plurality of pixels that receives the scan signals, the emission control signals, the data signals and the power so as to display an image, the pixel unit being partitioned into a plurality of partition areas to correspond to the respective power supply inlet portions; and a current limit circuit configured to calculate values of current for each of the partition areas based on gray scale data of an image signal, and configured to correct the gray scale data so as to limit luminance of the pixel unit when at least one of the values of current for each partition area is a reference value or more, wherein the current limit circuit includes:

a conversion unit configured to convert the gray scale data into a data current value;

a calculation unit configured to calculate current values for each partition area by dividing the data current value, based on a predetermined current distribution rate for each partition area, and to accumulate data current values for one frame; and a comparison unit configured to decide whether the current values for each partition area are within a reference range.

2. The display device as claimed in claim 1, wherein the current limit circuit further includes:

a correction unit configured to correct the gray scale data, based on a correction coefficient; and a correction coefficient regulation unit configured to regulate the size of the correction coefficient according to the decision of the comparison unit.

3. The display device as claimed in claim 2, wherein the correction coefficient regulation unit decreases the correction coefficient when the maximum value among the current values for each partition area is no less than an upper limit of the reference range, and increases when the maximum value among the current values for each partition area is no greater than a lower limit of the reference range.

4. The display device as claimed in claim 3, wherein the correction coefficient is a value between 0 and 1.

5. The display device as claimed in claim 1, wherein the current limit circuit outputs a control signal for limiting the luminance of the pixel unit.

6. The display device as claimed in claim 5, wherein the control signal includes a data control signal output to the data driver or a scan control signal output to the scan driver.

7. The display device as claimed in claim 6, wherein the data driver outputs, as a data signal, a gray scale voltage selected according to the data control signal.

8. The display device as claimed in claim 6, wherein the scan driver controls a pulse width of the emission control signals according to the scan control signal.

9. The display device as claimed in claim 1, wherein the power supply inlet portions are arranged at a top and bottom of an outside of the pixel unit, or at the left and right of the outside of the pixel unit, or at the top, bottom, left and right of the outside of the pixel unit.

* * * * *